US006182796B1

(12) United States Patent
Perlstein et al.

(10) Patent No.: US 6,182,796 B1
(45) Date of Patent: Feb. 6, 2001

(54) VEHICLE LIFT

(75) Inventors: Steven G. Perlstein, Niskayuna; Rick D. Wells, Sr., Broadalbin; Don A. Kessler, Amsterdam; Ronald W. Veresko, Schenectady; Bruce R. Teeling, Galway, all of NY (US)

(73) Assignee: Mohawk Resources Ltd., Amsterdam, NY (US)

( * ) Notice: Under 35 U.S.C. 154(b), the term of this patent shall be extended for 0 days.

(21) Appl. No.: 09/183,167

(22) Filed: Oct. 30, 1998

Related U.S. Application Data

(60) Provisional application No. 60/063,771, filed on Oct. 31, 1997.

(51) Int. Cl.[7] ..... B66F 7/10

(52) U.S. Cl. ..... 187/208; 187/211; 187/219; 187/221; 187/275; 254/122

(58) Field of Search ..... 187/206, 208, 187/211, 269, 275, 219; 254/122

(56) References Cited

U.S. PATENT DOCUMENTS

| | | | | |
|---|---|---|---|---|
| 2,777,538 | * | 1/1957 | Cochin | 187/219 |
| 3,628,771 | * | 12/1971 | Egeland et al. | 187/269 |
| 3,844,421 | | 10/1974 | Nielsen | 214/1 A |
| 3,991,857 | * | 11/1976 | Wolk et al. | 187/269 |
| 4,403,680 | * | 9/1983 | Hillesheimer | 187/269 |
| 4,447,042 | | 5/1984 | Masui | 254/90 |
| 4,577,821 | | 3/1986 | Edmo et al. | 248/421 |
| 4,690,250 | * | 9/1987 | Bergstrom | 187/211 |
| 4,724,930 | | 2/1988 | VanLierop | 187/8.43 |
| 4,815,712 | * | 3/1989 | Kawada | 187/211 |
| 4,901,980 | | 2/1990 | Hansen | 254/9 C |
| 4,909,357 | | 3/1990 | Kawada | 187/8.5 |
| 4,976,336 | * | 12/1990 | Curran . | |
| 5,029,814 | * | 7/1991 | Liegel et al. | 254/122 |
| 5,031,726 | | 7/1991 | Wakamiya | 187/8.41 |
| 5,090,508 | | 2/1992 | Nishikawa | 187/8.43 |
| 5,156,238 | | 10/1992 | Matthews | 187/8.72 |
| 5,192,053 | * | 3/1993 | Sehlstedt | 187/269 |
| 5,193,649 | | 3/1993 | Lee | 187/9 R |
| 5,322,143 | | 6/1994 | Curran | 87/8.49 |
| 5,340,082 | | 8/1994 | Holloway | 254/88 |
| 5,377,782 | | 1/1995 | Francis et al. | 187/219 |
| 5,636,711 | | 6/1997 | Nussbaum | 187/211 |

OTHER PUBLICATIONS

"Porta Contact Frame Lift or Roll–On Lift—Installation and Service Manual—Autoquip."

"6,000–LB. Portable Lift—Model P–6—Mohawk," Mohawk Resource Ltd., Amsterdam, New York.

"6,000–LB. Portable Lift—Model P–6—No Post, Space–Saving, Portable Lift—Mohawk," Mohawk Resources Ltd., Amsterdam, New York, 1994.

* cited by examiner

*Primary Examiner*—Robert P. Olszewski
*Assistant Examiner*—Steven B. McAllister
(74) *Attorney, Agent, or Firm*—Heslin & Rothenberg, P.C.

(57) ABSTRACT

Apparatus for use in lifting a vehicle from a substantially flat surface. The apparatus includes a pair of levers, each having a first lever and a second lever pivotally joined together cris-crossing one another and operable in a scissor-like motion between a collapsed position and a lifted position. A lifting platform is operatively coupled to the levers for supporting a vehicle thereon. A lifting mechanism is operably coupled to the levers for operating them between the collapsed position and the lifted position and thereby raising and lowering the lifting platform. An extendable, one-way incrementally lockable safety strut is pivotally connected to the first lever at a point along its upper portion and the other end of the safety strut is pivotally connected to the second lever at a point along its lower portion.

17 Claims, 13 Drawing Sheets

VEHICLE LIFT

This Appln claims the benefit of U.S. Provisional No. 60/063,771 filed Oct. 31, 1997.

FIELD OF THE INVENTION

This invention relates generally to lift devices, and particularly, to a full-rise safety operated vehicle lift.

BACKGROUND OF THE INVENTION

Several different vehicle lifts exist in the market place. Generally, these are designed within the constraints set by the design requirements of the lift, e.g., lifting capacity, lifting height, type of vehicle lifted, lift structure configurations and costs of materials and individual components. Thus, conventional designs represent a compromise between these different features.

There is a particular need for a vehicle lift that preferably does not suffer from the constraints of the conventional designs and that has the versatility to service a variety of vehicles in a variety of environments. Further, a vehicle lift is needed which preferably collapses to minimize storage space and enables lifting of a vehicle at multiple lifted positions between a collapsed position and a full-rise height of about six feet. Still further, a vehicle lift is needed which preferably maximizes access to the under side of a lifted vehicle while providing anti-collapse safeguards whenever the lift is not in the collapsed position. Yet further, a vehicle lift is needed which preferably is readily portable from one location to another.

As disclosed hereinafter, the vehicle lift of the present invention does not suffer from the constraints of the conventional designs. Also, the vehicle lift of the present invention preferably fulfills one or more of the above needs for a vehicle lift and most preferably all such needs.

SUMMARY OF THE INVENTION

According to the present invention there is provided an apparatus for use in lifting a vehicle from a substantially flat surface. The apparatus includes a pair of levers which include a first lever and a second lever pivotally joined together cris-crossing one another and operable in a scissor-like motion between a collapsed position and a lifted position. Each lever has an upper portion terminating in a top end and a lower portion terminating in a bottom end so that the top end of each lever lies opposite the bottom end of the other when the levers are in the collapsed position. A lifting platform is operatively coupled to the top ends of the levers for supporting a vehicle thereon. A lifting mechanism is operably coupled to the pair of levers for operating the pair of levers between the collapsed position and the lifted position and thereby raising and lowering the lifting platform. An extendable, one-way incrementally lockable safety strut has two ends. One end of the safety strut is pivotally connected to the first lever at a point along its upper portion and the other end of the strut is pivotally connected to the second lever at a point along its lower portion.

Other features of the invention relate to the configuration and operation of the safety strut which, for example, although moving in tandem with the pair of levers is independent of the lifting mechanism.

Still other features of the invention concern the configuration and operation of two pair of levers, and corresponding components for using the same, which enhance unrestricted access to the underbody of a lifted vehicle while simultaneously fulfilling safety and lifting range considerations.

According to other features of the invention there are provided infinite vehicle frame or tire engagement positions which enable the apparatus to accommodate today's late (1990's) non-homogenous vehicles which have a multitude of frame and tire widths, a variety of wheelbase lengths, various ground clearances and various pick-up points.

DESCRIPTION OF THE DRAWINGS

Other features of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
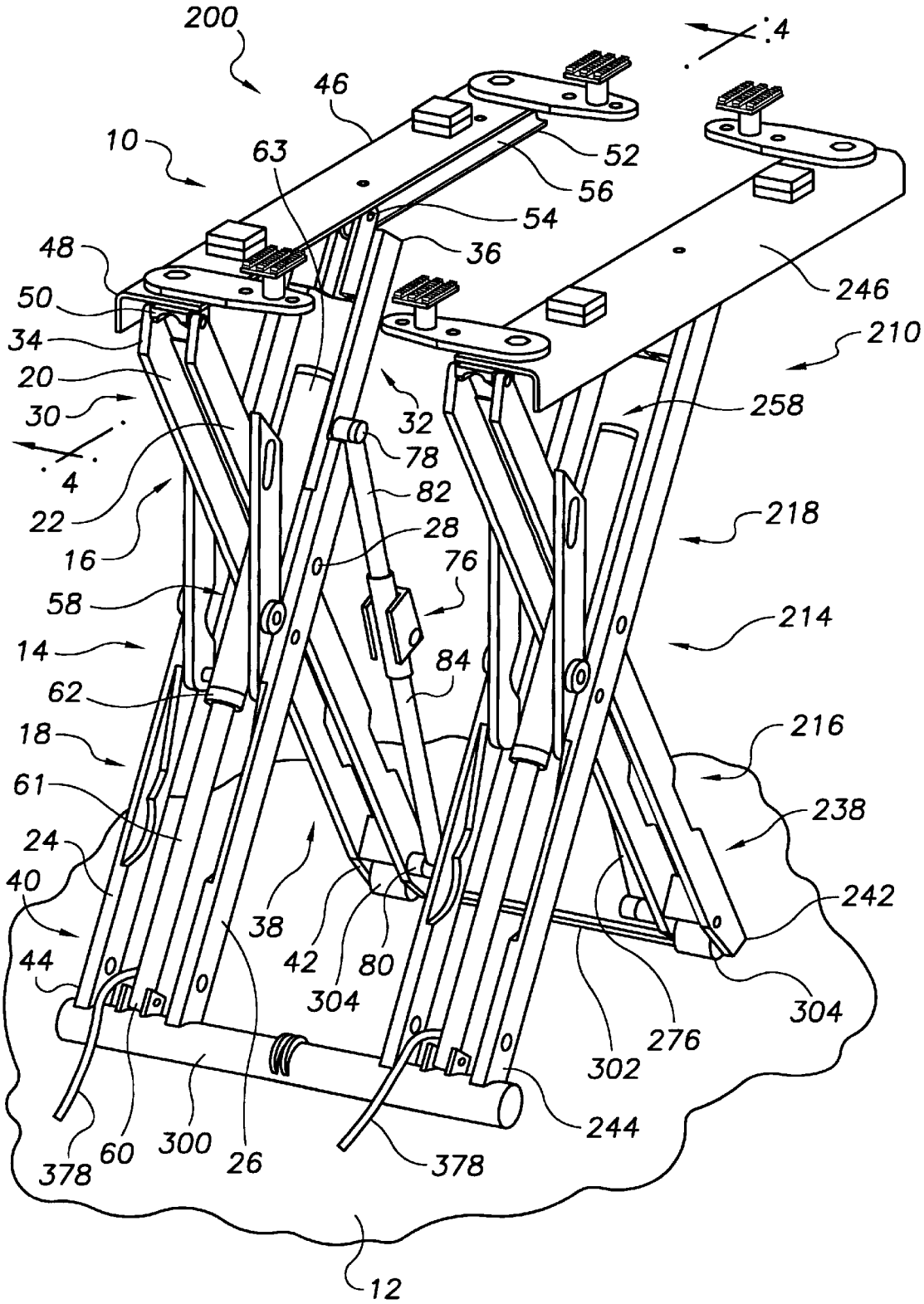
FIG. 1 is a perspective rear view of a lift assembly, including two lift apparatus, in a fully lifted position.
Figure 2:
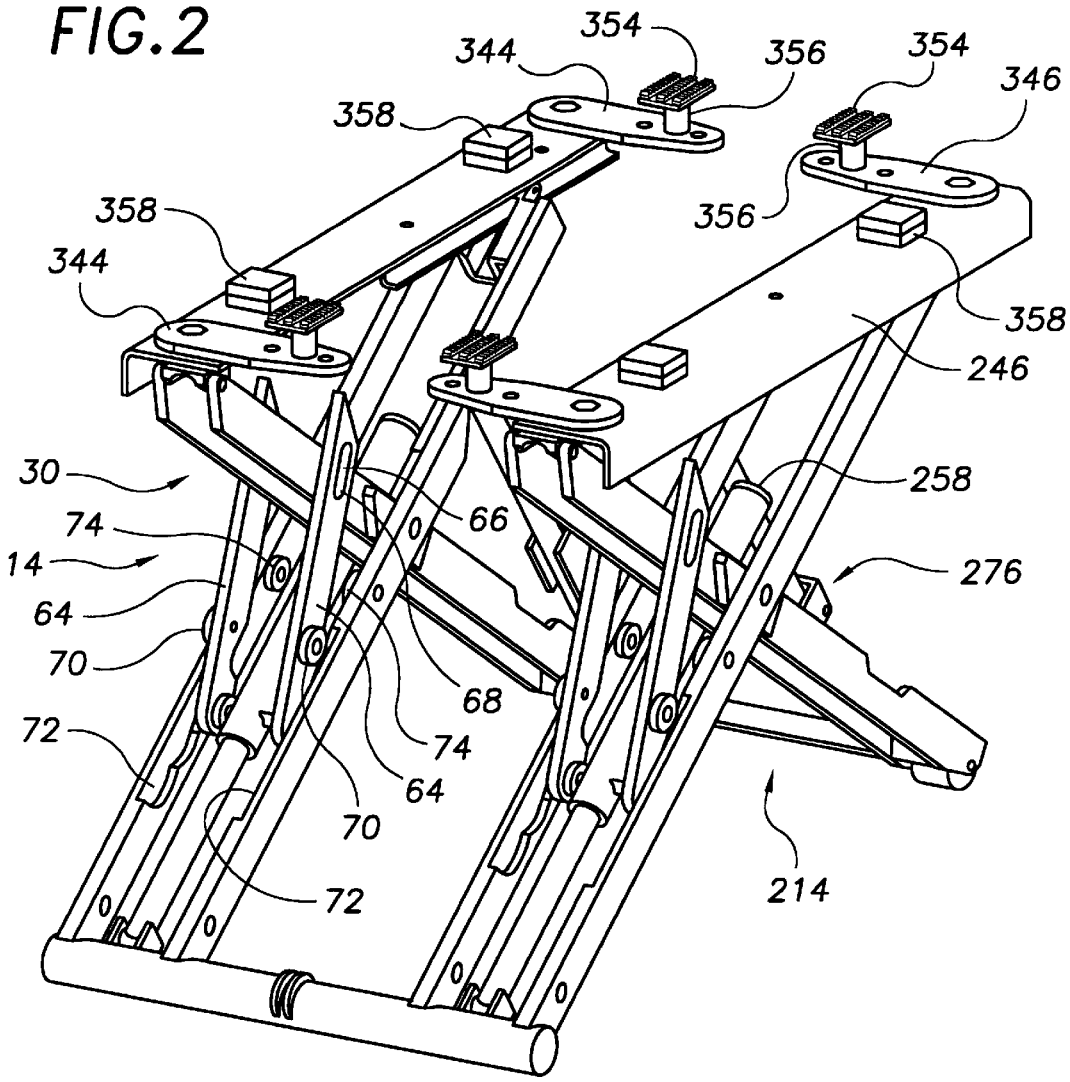
FIG. 2 is a view similar to FIG. 1 but with the lift assembly in between the fully lifted position and a collapsed position.
Figure 3:
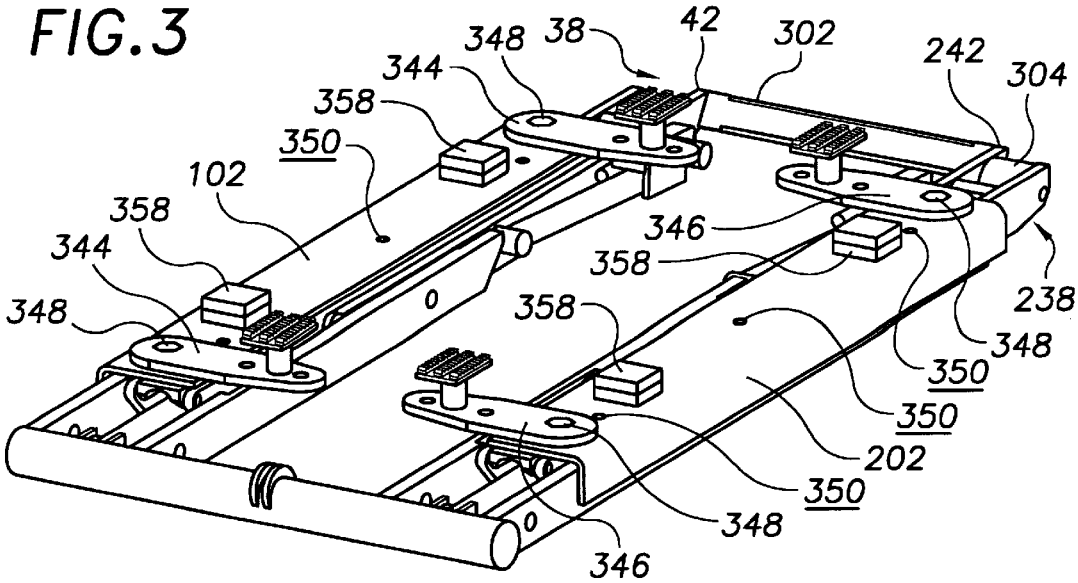
FIG. 3 is a view similar to FIG. 1 but with the lift assembly in the collapsed position.
Figure 4:
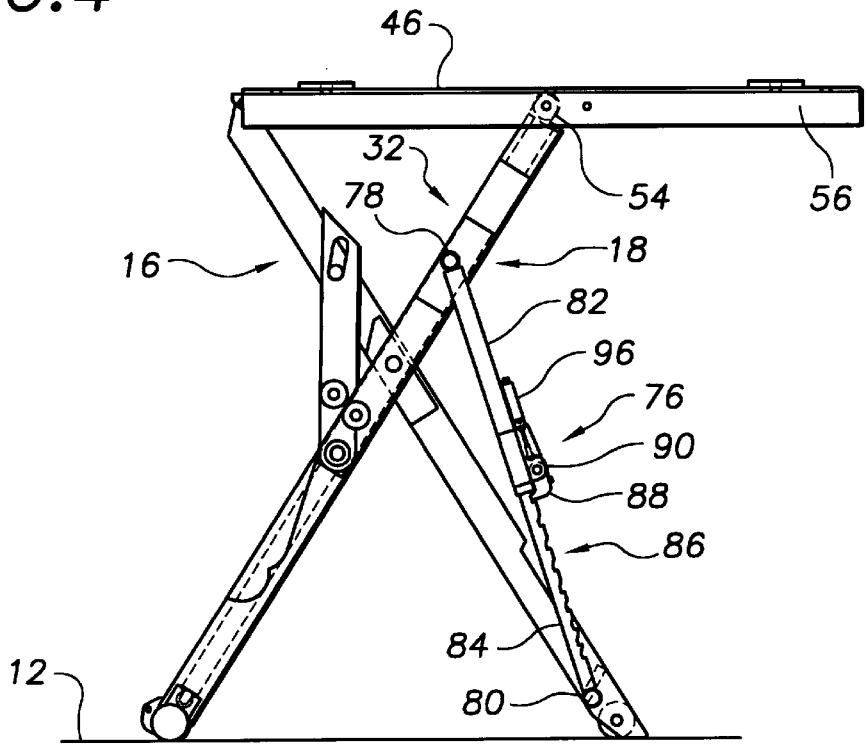
FIG. 4 is a partial side view of the lift assembly of FIG. 1, taken along line 4—4 of FIG. 1.
Figure 5:
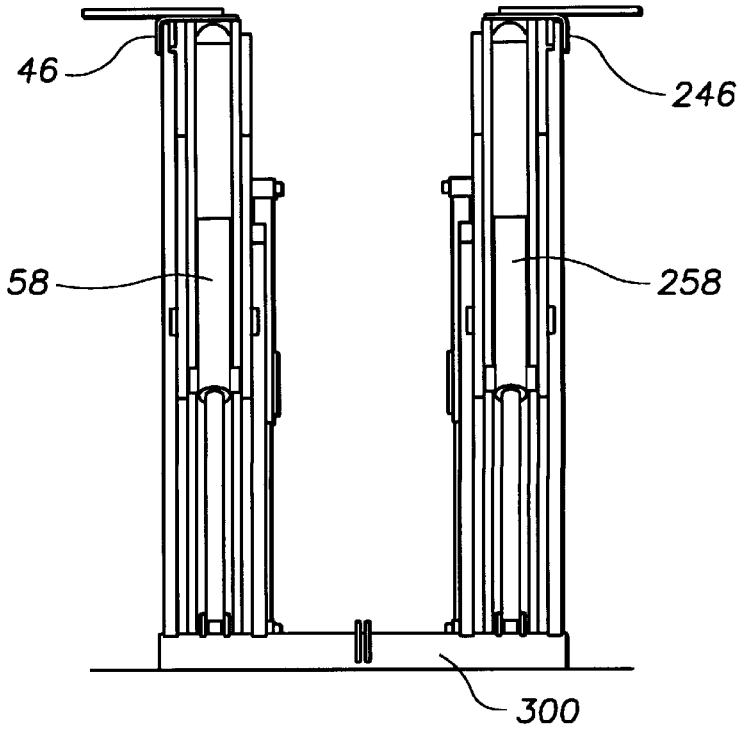
FIG. 5 is a rear view of the lift assembly of FIG. 1, with swing arms but without lifting accessories.

Referring to FIGS. 1–4 generally, for example, there is depicted a lift apparatus 10 for use in lifting a vehicle (not shown) from a substantially flat surface 12. Generally, lift apparatus 10 includes a pair of levers 14 each having a first lever 16 and a second lever 18 pivotally joined together cris-crossing one another and operable in a scissor-like motion between a collapsed position (FIG. 3) and a lifted position (FIGS. 1, 2 and 4). For example, levers 16, 18, may each include paired members 20, 22 and 24, 26, respectively, which may be connected together by conventional fitted pins 28 (second pin not visible but similarly located) proximate their middle for pivotal movement but otherwise being fixed relative thereto. Each lever 16, 18, may also have an upper portion 30, 32, respectively, terminating in a top end 34, 36, respectively, and a lower portion 38, 40, respectively, terminating in a bottom end 42, 44, respectively, so that the top end of each lever lies opposite the bottom end of the other when levers 16, 18 are in the collapsed position (FIG. 3). Preferably, lever members 20, 22, 24, 26 are constructed from 1 and ½ inch by 3 inch machine milled steel. Moreover, unless provided differently herein, all components are constructed of steel and are sealed to prevent corrosion.

Figure 6:
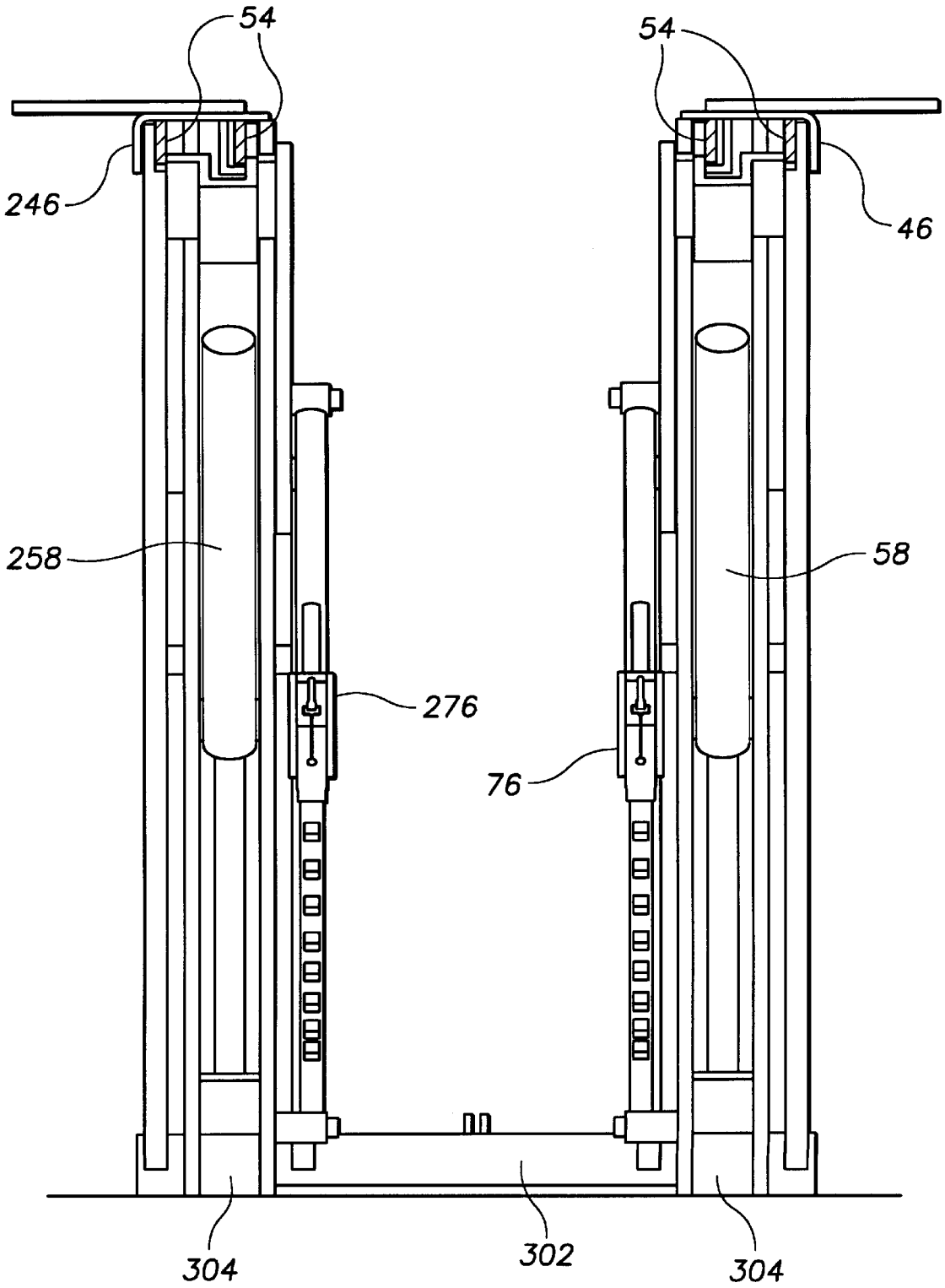
FIG. 6 is a front view of the lift assembly of FIG. 1, with swing arms but without lifting accessories.
Figure 7:
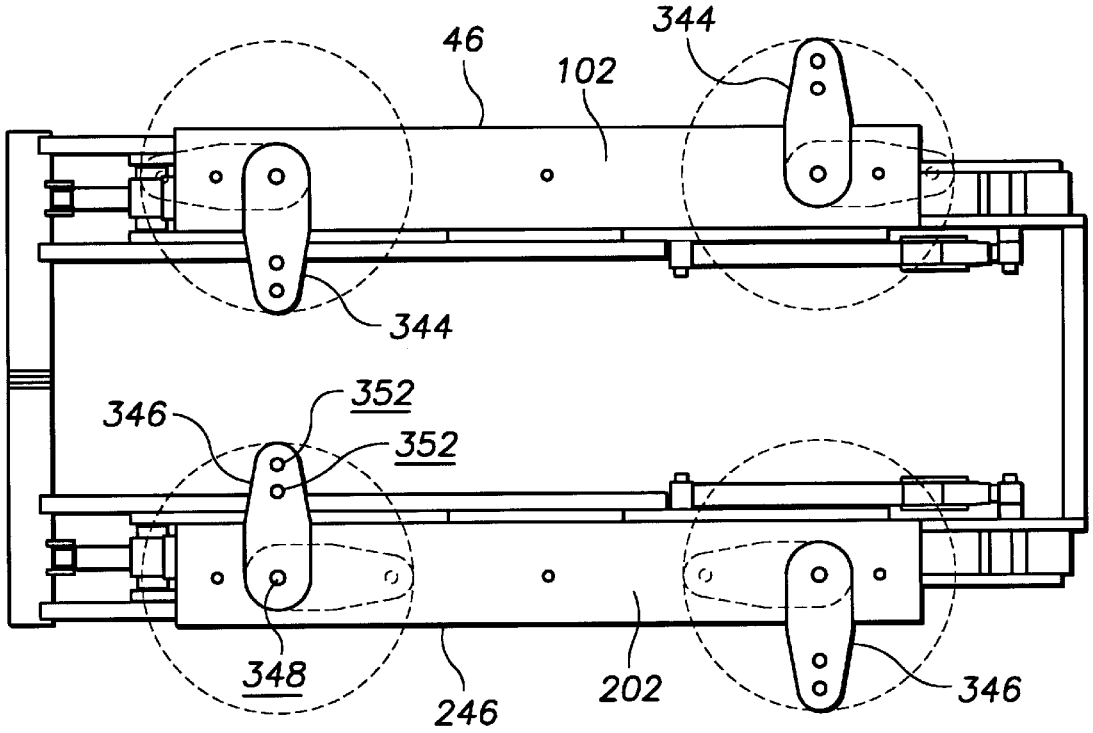
FIG. 7 is a top view of the lift assembly of FIG. 3, with swing arms but without lifting accessories.
Figure 8:
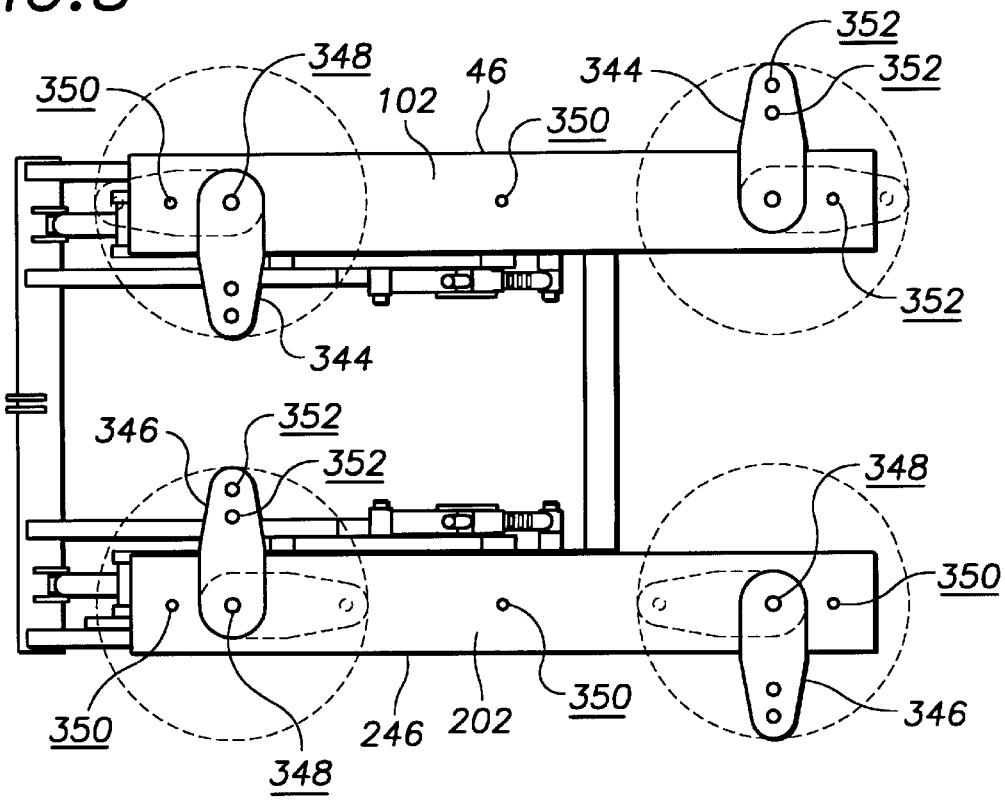
FIG. 8 is a top view of the lift assembly of FIG. 1, with swing arms but without lifting accessories.

A lifting platform 46 is operatively coupled to top ends 34, 36 for supporting the vehicle thereon. For example, rear end 48 of lifting platform 46 can be connected by a conventional hinge 50 to top end 34 for pivotal movement but otherwise is fixed relative thereto. Differently, preferably front end 52 of lifting platform 46 can be connected to top end 36 by a pair of rollers 54 (see also FIG. 6) trapped on opposite sides in platform L-shape guide 56. In this way, top end 36 moves pivotally and axially relative to lifting platform 46 and also prevents lifting platform 46 from twisting (torquing) away from pair of levers 16, 18.

Referring to FIGS. 1 and 2, for example, a lifting mechanism 58 is operably coupled to levers 16, 18 for operating the pair of levers between the collapsed position and the lifted position and thereby raising and lowering lifting platform 46. Lifting mechanism 58 could be any conventional hydraulic cylinder that may have a preferred lifting stroke of 26 inches and may preferably be direct drive cylinder using no cables, chains or mechanical lifting screws. For example, the lifting mechanism may include a conventional hydraulic cylinder but which cylinder has the following rod fed configuration. An aluminum piston head (not shown), having an outer diameter of about 3 inches, is within piston cylinder 63 and connected to piston rod 61. Rod 61 has about a 2 inch outer diameter and about a ¾ inch inside diameter and is hollow in the center for conducting the hydraulic fluid to the piston chamber within the hydraulic cylinder. Rod 61 is fitted for sliding engagement within piston cylinder 63, where the cylinder has an outer diameter of about 3 and ½ inches and an inner diameter of about 3 inches. These dimensions preferably combine to give a pressure area of about 6.627 square inches i each hydraulic cylinder. The rod and cylinder are both steel. The hydraulic fluid is preferably maintained at 50 to 130 degrees Fahrenheit. Further, hydraulic line 378 is connected to piston rod 61, by conventional means, for supplying hydraulic fluid thereto.

Lifting mechanism 58 may be connected at piston rod end 60 to bottom end 44 by conventional means for pivotal movement but otherwise is fixed relative thereto. Piston cylinder end 62 may be connected to linkage levers 64 (FIG. 2) by conventional means for pivotal movement but otherwise being fixed relative thereto. Linkage levers 64 are connected to upper portion 30 by slots 66 (second slot not visible but similarly located) which capture pins 68 (second pin not visible but similarly located) connected to opposite sides of lever 16. Linkage levers 64 are preferably not connected to lever 16 but are mounted for horizontal, vertical and rotational movement relative thereto.

Referring to FIG. 2, for example, linkage levers 64 also include wheels 70 mounted for rotational movement but otherwise being fixed relative thereto. Wheels 70 engage respective lever guides 72 and serve to direct the movement of linkage levers 64 when lift apparatus 10 is moved between the collapsed and lifted positions in the range of fully collapsed to about one-half lifted. Additionally, second wheels 74 may be mounted to lever members 24, 26 respectively, for rotational movement but otherwise being fixed relative thereto. Second wheels 74 serve to limit and guide linkage levers 64 when lift apparatus 10 is moved between the collapsed and lifted positions, nearer the collapsed range of positions.

Figure 13:
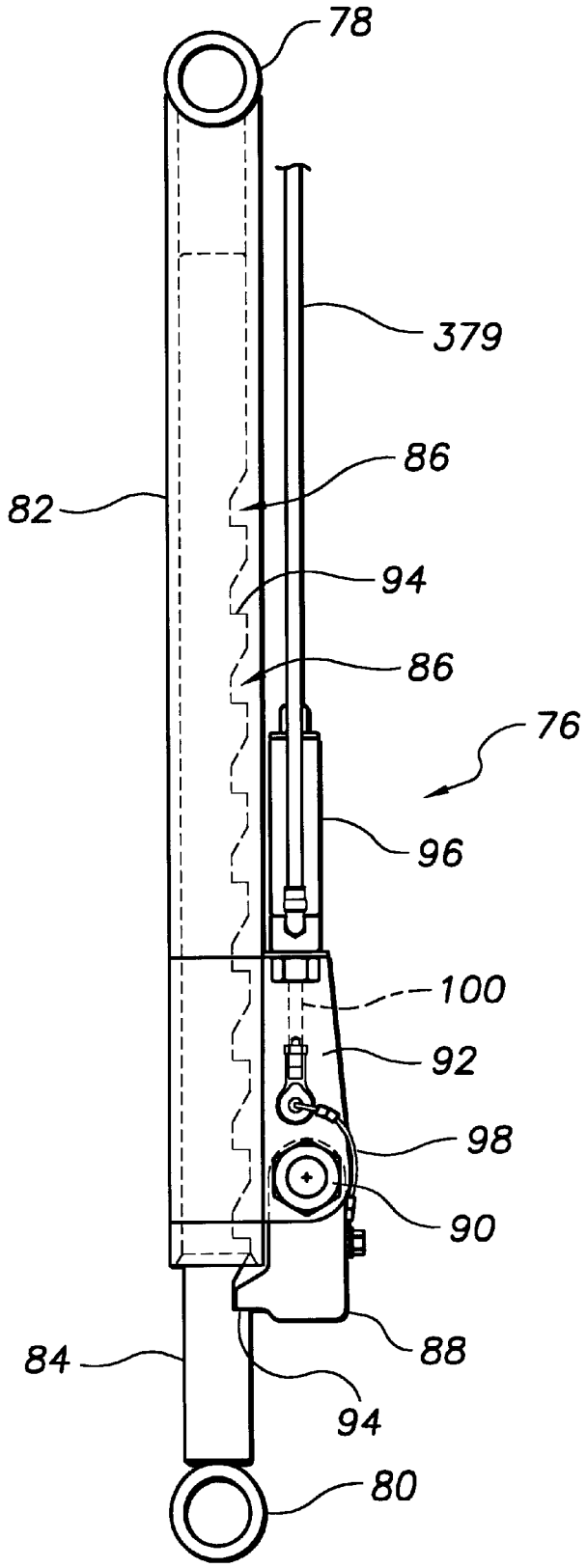
FIG. 13 is an enlarged partial cutaway side view of a safety strut of each lift apparatus.

Referring to FIGS. 1, 4 and 13, for example, an extendable, one-way incrementally lockable safety strut 76 has two ends 78 and 80. Each end is pivotally connected by conventional means to its respective lever 16, 18. For example, strut end 78 is connected to lever 18 at a point along upper portion 32 and strut end 80 is connected to lever 16 at a point along lower portion 30. Safety strut 76 may be a round steel tube 82 sized to receive a steel rack or rod 84 for fitted sliding engagement therein. Rack 84 has a number of slots 86, and preferably 10 slots starting at 6 inches from end 80 and extending along its length. Slots 86 are contoured so as to enable one-way movement of a cam 88 when cam 88 engages rack 84, i.e., during lifting movement of the lift apparatus as described hereinafter.

Referring to FIGS. 4 and 13, for example, cam 88 is connected to tube 82 by a nut and bolt combination 90 which are connectable with a pair of spaced plates 92 (second plate not visible but similarly located) connected to the outside of tube 82. The cam can rotate up and down but otherwise is fixed relative to tube 82. Cam 88 may engage rack 84 merely by gravity or by additional force supplied through a spring or other conventional means. If cam 88 engages portion 94 of slots 86 with a downward force, it will lock the rack 84 relative to tube 82 preventing contraction of the strut 76 and thereby levers 16, 18 to which it is connected. To disengage cam 88 from rack 84 at any time, conventional air cylinder 96 connected to tube 82 may be linked to cam 88 by cable 98 attached to air cylinder rod 100. When air cylinder rod 100 is retracted into air cylinder 96, it tenses cable 98 and pulls cam 88 away from rack 84, thereby enabling retraction of rack 84 into tube 82. Air cylinder 96 preferable is a single point air release, single act type cylinder, such as that sold by Parker Hannifin Corporation under model number 1.06PTSRS01.5. Conventional air supply line 379 is connectable thereto for providing the desired pneumatic pressure.

Referring to FIGS. 1–4, an operational example of the lift apparatus follows. As lifting mechanism 58 is caused to operate from the collapsed position to the lifted position, piston cylinder end 62 is forced away from piston rod end 60. This drives the linkage levers 64 and their respective wheels 70 along and out of the lever guides 72. Near simultaneously, slots 66 in linkage levers 64 are forced into engagement with pins 68. As soon as slots 66 stop against pins 68, levers 16, 18 are driven from the collapsed position and moved in any of various lifted positions. Also near simultaneously, as levers 16, 18 are driven apart, safety strut 76 connected at opposite ends to each lever 16, 18 respectively, is extended in length. As this occurs, cam 88 slides into slots 86 and thereby incrementally locks levers 16, 18 from collapsing should lifting mechanism 58 or its hydraulic supply (discussed hereinafter) fail or should a user inadvertently lower the lift apparatus. During operation, it is further preferred that lift apparatus 10 move in a straight up and down direction with substantially no horizontal movement. It is also preferred that the lift assembly 210 be self lubricating at all scissor like pivot points, by conventional means.

To move lift apparatus 10 from a lifted position to the collapsed position, cam 88 must be disengaged from slot 86 and rack 84. Rack 84 can then slide into tube 82 as the piston rod of lifting mechanism 58 is retracted into the piston cylinder. To further enhance the safety provided by safety strut 76, it is preferably separate and distinct from lifting mechanism 58. This also has the advantage of maximizing underbody vehicle access while still providing the desired safety features. Further, these features can also combine to enable a maximum lifted position height of more than six feet which is preferred for taller mechanics working under the vehicle.

Referring generally to FIGS. 1–6, for example, such safety features are particularly preferred when lift apparatus 10 further includes a lift assembly 200. Lift assembly 200 includes a second lift apparatus 210 similar to lift apparatus 10. Lift apparatus 210 includes a second pair of levers 214 which include a third lever 216, a fourth lever 218, a second lifting platform 246, a second lifting mechanism 258 and a second safety strut 276. These second components are identical to their correspondingly named first components in all respects except for the lifting platforms 46, 246 which are mirror images of one another. Further, components in lift apparatus 210 corresponding to those of lift apparatus 10 are numbered similarly but increased by an increment of 200. In lift assembly 200, preferably pair of levers 14 is sychronistically joined with second pair of levers 214 in an opposing substantially parallel relationship such that they are joined together substantially only proximate flat surface 12 when each is in a position other than the collapsed position. This configuration can be desired because it, in combination with the safety features discussed for each lift apparatus 10, 210 above, further enhances underbody vehicle access while still providing safe and reliable lifting features.

Various means may be employed to achieve the desired synchronicity. For example, a ground engaging member 300 may be connected between adjacent rear bottom ends 44, 244 of pairs of levers 14, 214. In this regard, ground engaging member 300 preferably is a rigid steel tube connected by conventional means such as welding, forming integral or the like to the pairs of levers 14, 214 and which also serves to resist torque differentials cause by the pairs of levers 14, 214 during operation. Further, ground engaging member 300 may substantially fix adjacent rear bottom ends 44, 244 to flat surface 12 merely by frictional engagement therewith to prevent linear movement of the ends relative to flat surface 12 when pairs of levers 14, 214 are operated.

Still referring to FIGS. 1–6, an additional or alternative means to achieve the desired synchronicity may include a synchronization member 302 connected between adjacent front bottom ends 42, 242 of each respective pair of levers and proximate flat surface 12. Member 302 preferably is a length of steel connected by conventional means such as welding or other conventional bonding means to pairs of levers 14, 214 and which also serves to resist torque differentials caused by pairs of levers 14, 214 during operation. Further, each adjacent front bottom portion 38, 238 may include a roller 304 which slidingly engages flat surface 12 when the pairs of levers 14, 214 are moved between the collapsed position and the lifted position. As mentioned earlier, lift apparatus 10 preferably moves in a straight up and down direction with substantially no horizontal movement. For example, this may be achieved as ends 44, 244 remain substantially fixed relative to flat surface 12 (except for rotational movement) by ground engaging member 300 but ends 42, 242 roll towards and away from ends 44, 244 when the pairs of levers 14, 214 operate between lifted positions and the collapsed position.

Figure 18:
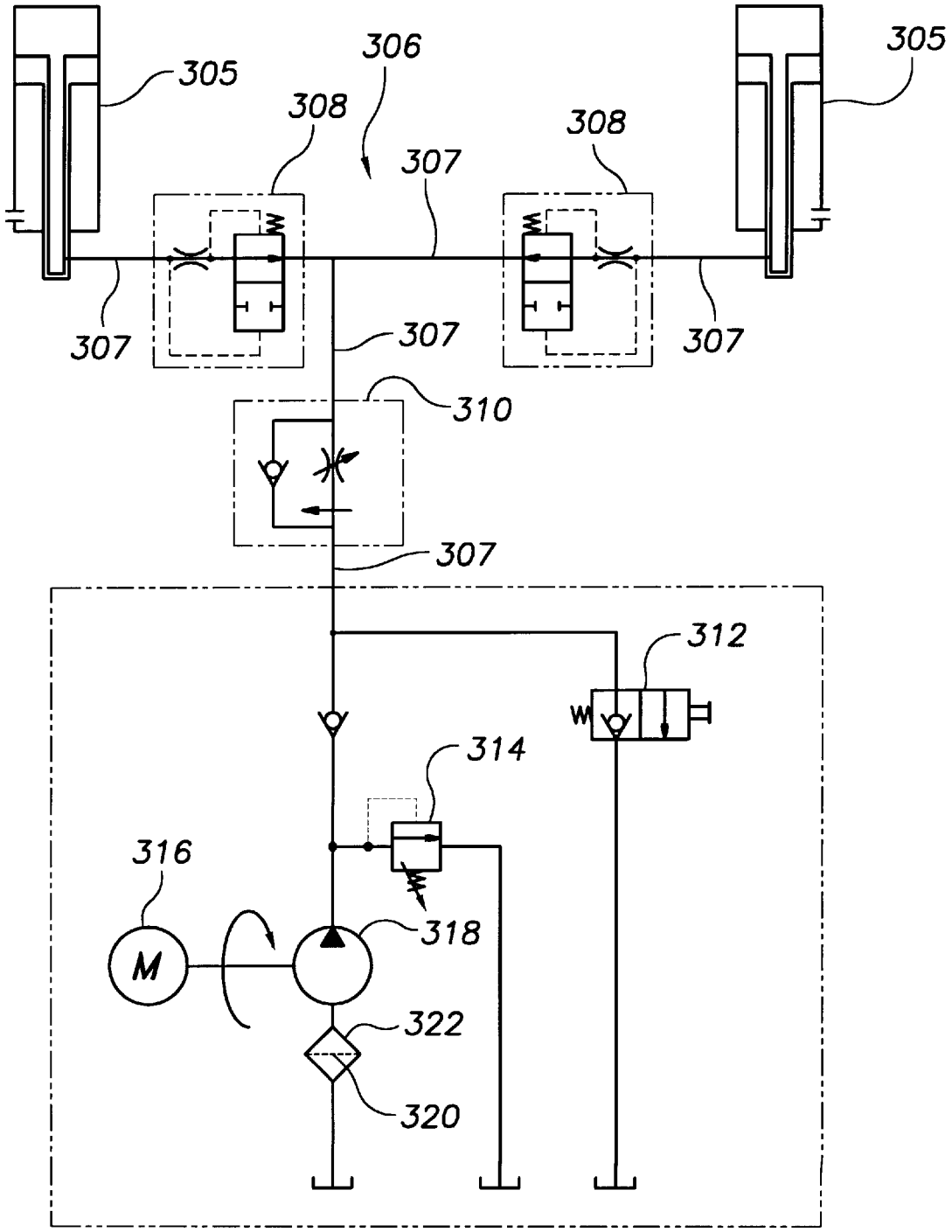
FIG. 18 is a schematic representation of a hydraulic system of the lift assembly.
Figure 19:
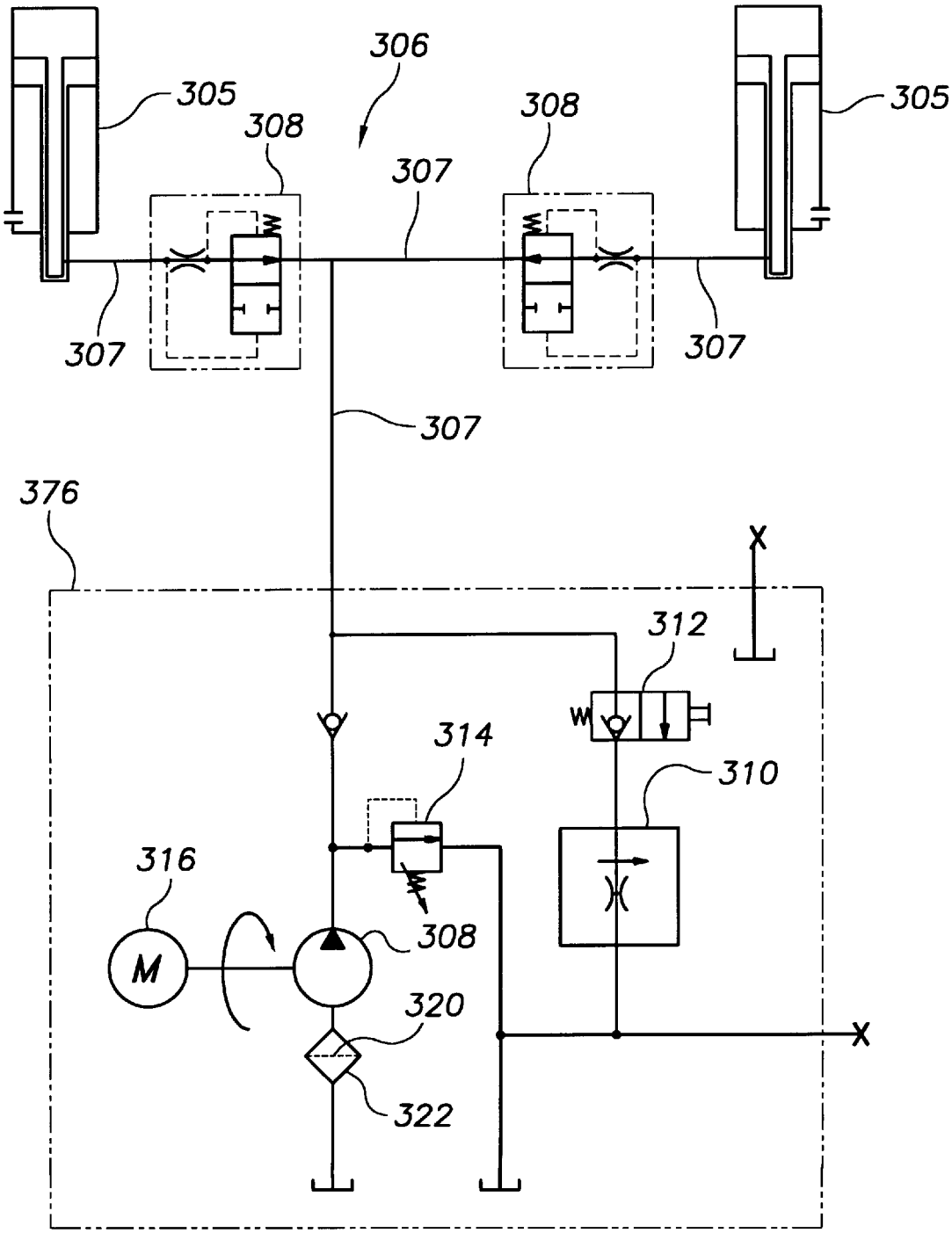
FIG. 19 is a schematic representation of an alternative exemplary embodiment of the hydraulic system of the lift assembly.

Referring to FIGS. 18 and 19 are depicted schematic representations of lifting mechanisms 58, 258, e.g., conventional hydraulic cylinders 305 and a hydraulic fluid supply system 306. Cylinders 305 and system 306 may be linked by conventional hydraulic lines (only shown schematically), generally ¼ inch lines, and with conventional fittings except as noted hereinafter. System 306 or hydraulic cylinders 305 may include, for example, at least one conventional velocity fuse 308, preferably configured as shown and set at 4 gallons per minute. Velocity fuses 308 for each hydraulic cylinder can prevent fatal collapse in the remote possibility that a hydraulic line ruptures. For example, a velocity fuse sold by Vonberg Valve, Inc. under model number 28001-503-4 may produce excellent results. Still further, system 306 may include, for example, a conventional pressure compensated flow control valve 310, preferably configured as shown and set at 2.75 gallons per minute. Pressure compensated flow control valve 310 can prevent excessive lowering speeds. For example, a flow control valve sold by Monarch Hydraulics, Inc. under model number 017270 may produce excellent results. Further components of system 306 may include conventional operating switch 312, conventional relief valve 314 (preferably set at 2450 psi) and conventional motor 316 (preferably a 2 HP, 230 VAC, 60 Hz) which operates conventional hydraulic pump 318 having at a capacity of pumping 1.77 gallons per minute and producing 2000 psi at 3435 rpm. A conventional 150 micron strainer 320 may be included in reservoir 322 and in communication with pump 318, where reservoir 322 preferably has a 2.5 gallon capacity.

FIGS. 9–12 inclusive depict two alternative embodiments of the invention. For example, each include a pair of longitudinal tracks 324 (FIGS. 9–10) and 326 (FIGS. 11–12) in which each of the pair is locatable adjacent lifting platform 46, 246 of each respective pair of levers 14, 214. In particular, the longitudinal tracks may each be a lifting track 328 (FIGS. 11–12) which is removably attached to lifting platforms 46, 246 of each respective pair of levers. Lifting tracks 328 may be constructed of U-shaped bent diamond floor plate sections 330 where two sections are welded together for each track. At the ends of each track 328, there may be provided a ramp 332 constructed of plate steel. Also, an L-shaped piece of angle iron 333 may be welded or bolted to one end to restrain the vehicle. Each ramp 332 may have a hinged connection 335 to the track, providing an automatic wheel stop 334 for the vehicle when the lift is raised. Each track 328 has three connection plates 336 welded to the top surface of the tracks. These connection plates extend beyond the outer edges of the tracks and have holes 337 provided for bolting the track to the top of lifting platforms 46, 246. Use of these tracks convert the standard frame engaging capability of the lift into a tire (wheel) engaging roll-on lift. Further, ramps 332 allow vehicles to enter from one end of the lift and drive off the other end, offering ease and speed to vehicle removal.

Figure 9:
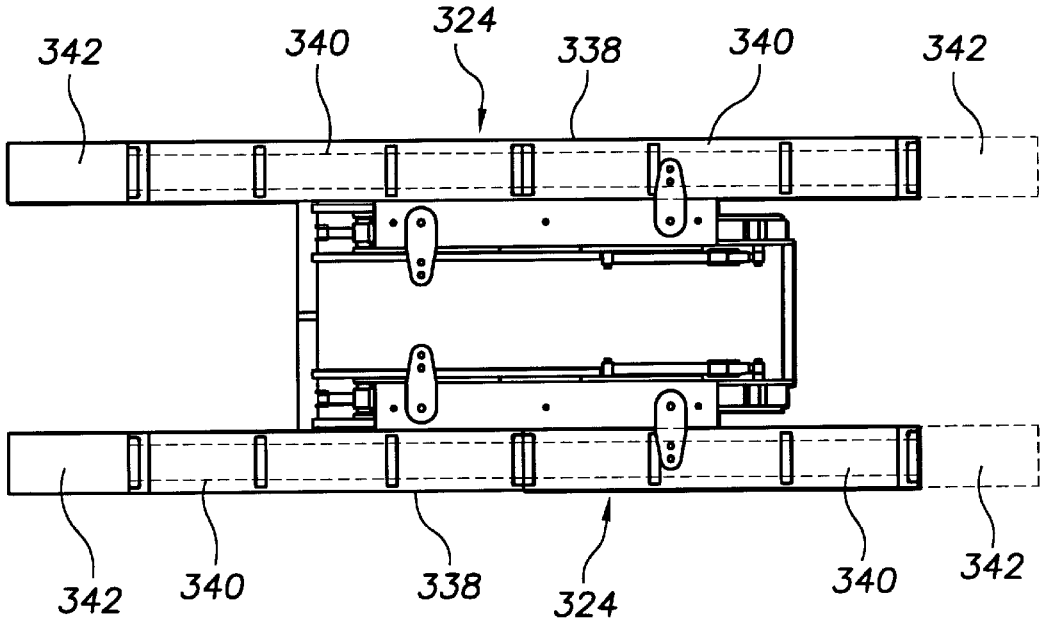
FIG. 9 is a top view of another embodiment of the lift assembly, in the collapsed position, with stationary tracks and swing arms but without lifting accessories.
Figure 10:
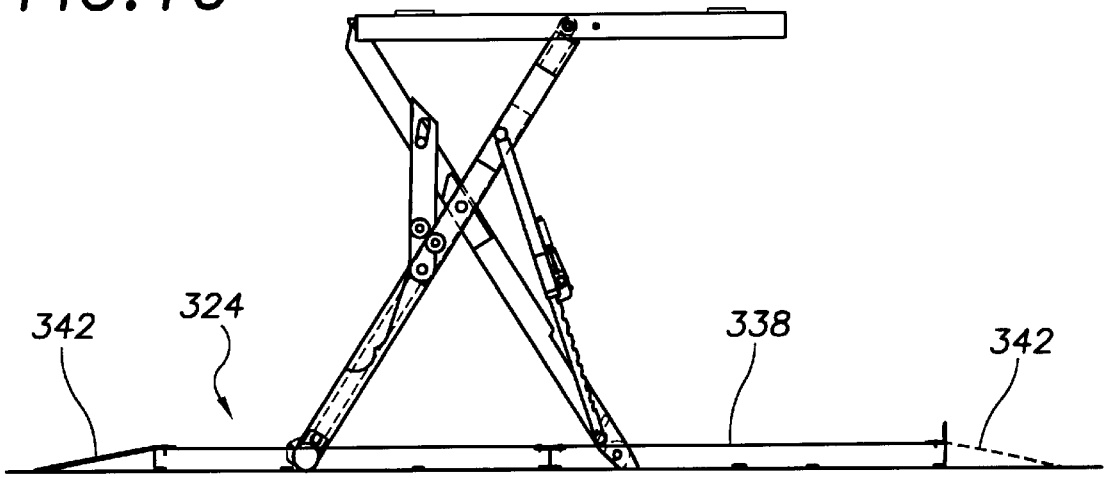
FIG. 10 is a partial side view of the lift assembly of FIG. 9, in the fully lifted position (similar to that of FIG. 4).
Figure 11:
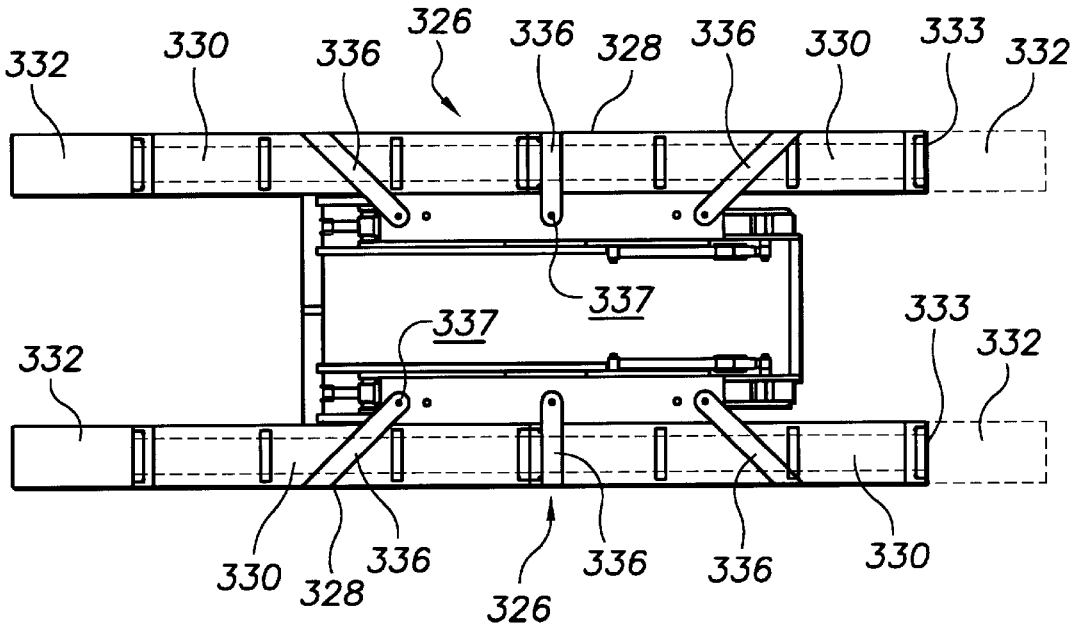
FIG. 11 is a top view of another embodiment of the lift assembly, in the collapsed position, with lifting tracks.
Figure 12:
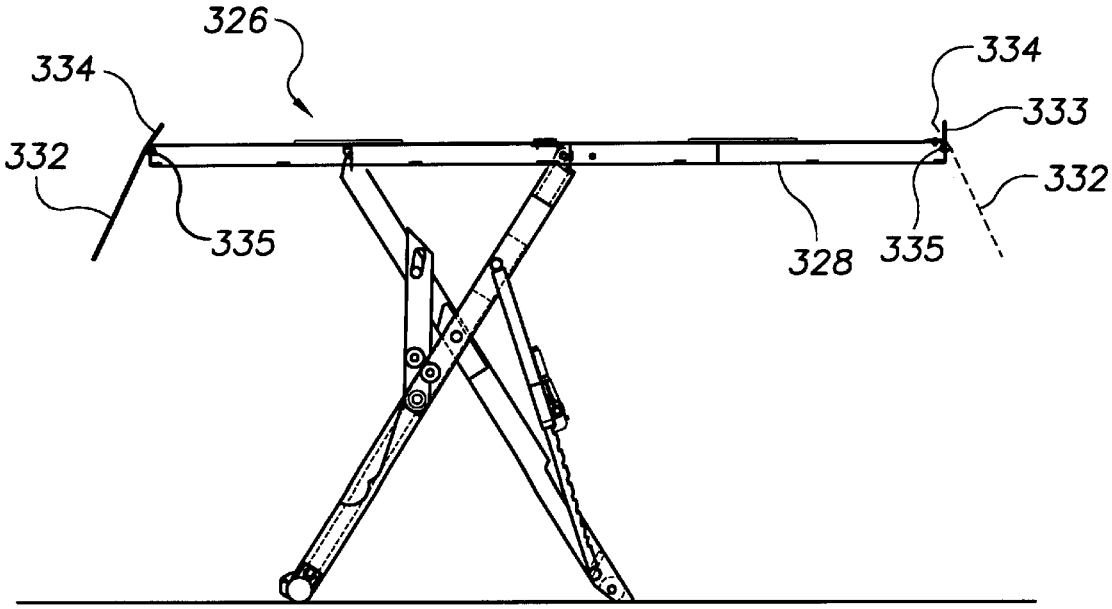
FIG. 12 is a partial side view of the lift assembly of FIG. 11, in the fully lifted position (similar to that of FIG. 4).

Alternatively, referring to FIGS. 9–10, longitudinal tracks 324 may each be a stationary track 338 which is positionable along side lifting platforms 46, 246 of each respective pair of levers 14, 214 and is disconnected therefrom. Stationary tracks 338 may be constructed of U-shaped bent diamond floor plate sections 340 where two sections are bolted together for each track. At the ends of each track is supplied a ramp 342 constructed of plate steel and bolted thereto. Also, an L-shaped piece of angle iron 333 may be welded or bolted to one end to restrain the vehicle. Preferably, all of the parts of the longitudinal tracks 324 are bolted connections, allowing quick assembly, disassembly and easy storage when not in use. The stationary tracks enable vehicles with low profile vehicle under-clearance to be positioned for use over lift assembly 200. Further, ramps 342 may also allow vehicles to enter from one end of the lift and drive off the other end, offering ease and speed to vehicle removal.

Referring to FIGS. 3, 7–8 and 17, for example, each lift apparatus 10, 210 may further include at least a pair of swing arms 344, 346 wherein each swing arm is removably joined to lifting platform 46, 246. In particular, for example, each lifting platform surface 102, 202 has tapped holes 350 allowing the mounting of swing arms 344, 346, which can rotate. Swing arms 344, 346 are made of steel plate, one end having a drilled hole to attach the swing arm to the platform with a threaded bolt 348 and the other end having two drilled holes 352 for placing height adapters or lifting pads (described hereinafter). Preferably, multiple swing arm 344, 346 connection locations are offered on lifting platforms 46, 246 to allow the user to alter the location of swing arms 344, 346 and thus, accommodate a wider variety of vehicle frame pick-up locations. This is particularly advantageous for today's (late 1990's) non-homogenous vehicles which have a multitude of frame/tire widths, wheelbase lengths, various ground clearances and pick up points, as opposed to the early 1960's vehicles which were all similar with large wide frames. In addition, easy removal of swing arms 344, 346 lowers the profile of lift apparatus 10, 210 to accommodate more of today's (late 1990's) low profile vehicles.

Figure 17:
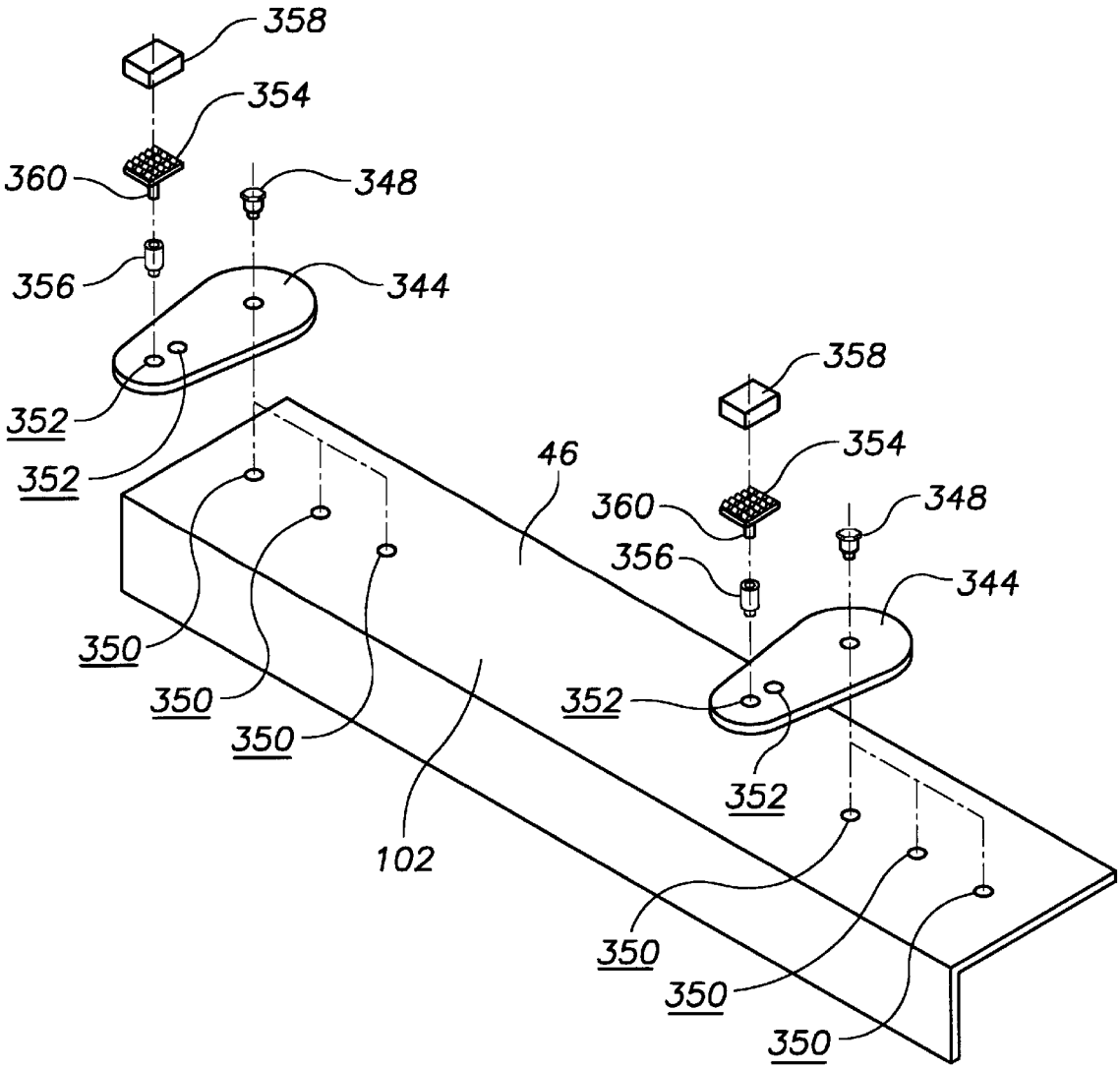
FIG. 17 is a perspective exploded view of a lifting platform, swing arms and lifting accessories of the lift apparatus.

Referring to FIGS. 2 and 17, for example, each lift apparatus 10, 210 may further include at least a pair of lifting accessories, such as those from the group consisting of lifting pads 354, height adapters 356 and rubber blocks 358. Each of the pair of lifting accessories is preferably removably joined with the lifting platforms 46, 246 so as to provide symmetry. In particular, the lifting accessories offer a variety of ways to engage the lifting points of a vehicle. For example, lifting pads 354 may be constructed of a small, e.g., 4" by 5", rectangular steel plate with a "rippled" top surface which offers an anti-slip surface for the pad to engage the vehicle frame. Normal to the plate's bottom surface extends a round pin 360, which is fittingly inserted into holes 352 in the end of swing arm 344, 346 or height adapter 356 when used. Height adapters 356 are stands-offs used in conjunction with lifting pads 354 to raise the surface of the lifting pad towards the frame contact point. Rubber blocks 358 can be used on lifting platforms 46, 246 on swing arms 344, 346 or on lifting pads 354. These three devices further offer a wide combination of vehicle frame engagement possibilities.

Figure 14:
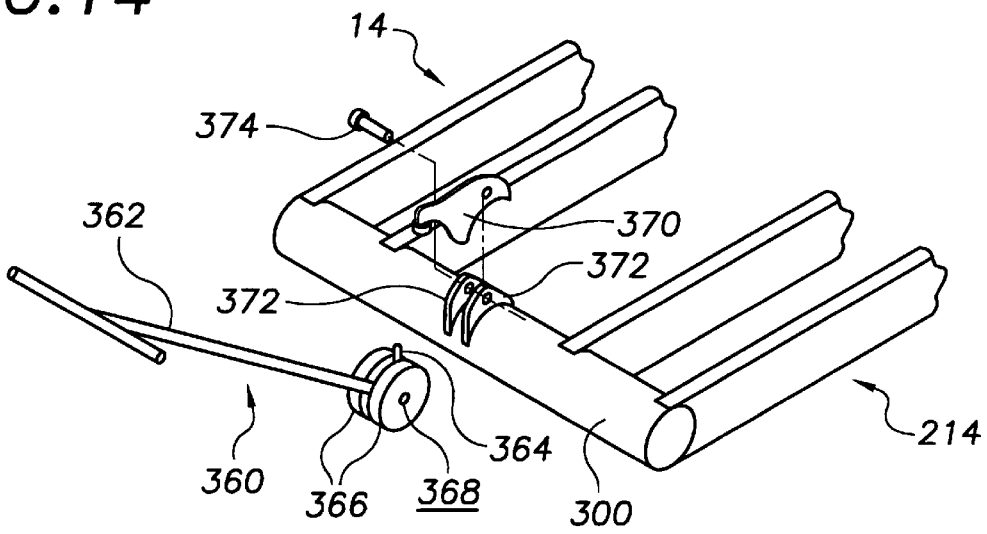
FIG. 14 is a perspective view of a portion of the lift assembly without lifting mechanisms and with its tow means in an exploded unassembled position.
Figure 15:
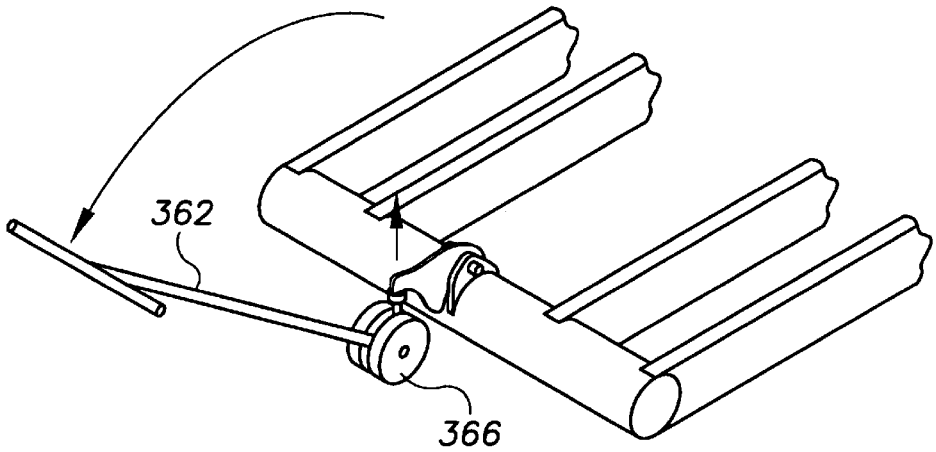
FIG. 15 is a perspective view of the lift assembly of FIG. 14, with its tow means in an assembled position and the lift assembly operationally portable.
Figure 16:
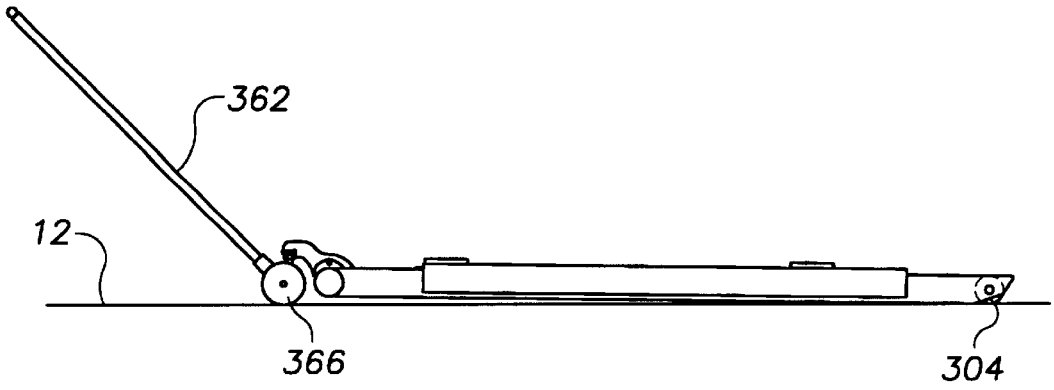
FIG. 16 is a side view of the lift assembly of FIG. 15, with lifting platforms and in the collapsed position.

Referring to FIGS. 14–16, lift assembly 200 may include a towing member 360 removably attachable with ground engaging member 300 in between the pairs of levers 14, 214. For example, towing member 360 includes a T-shaped bar 362 having an upwardly projecting pivot point 364. Two wheels 366 are attached on either side of pivot point 364 by conventional means such as a pin and retainer 368. Preferably, a tow support 370 is shaped to encompass ground engaging member 300 and be inserted between a pair of ears 372 which are connected to ground engaging member 300 by welding, forming integral or the like. A pin or bolt 374 can then be inserted into aligned holes of ears 372 and tow support 370 (FIG. 14) Towing member 360 can then be inserted under tow support 370 and rotated so as to raise grounding engaging member 300 and the rear end of lift assembly 200 off of flat surface 12 (FIG. 15). This is preferably done when the lift is in the collapsed position. Once ground engaging member 300 is "levered" off of flat surface 12, the rear end of lift assembly 200 is then supported by wheels or rollers 366 of towing member 360, and the front end of lift assembly 200 is supported by the rollers 304 (FIG. 16). Lift assembly 200, now on four rollers, can be pulled by a single person to a desired location.

Figure 21:
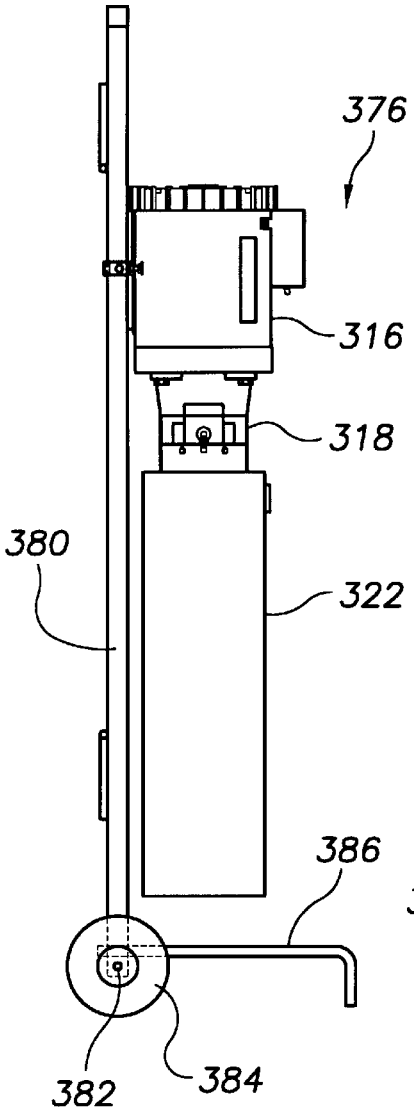
FIG. 21 is a side view of the power unit of FIG. 20.
Figure 20:
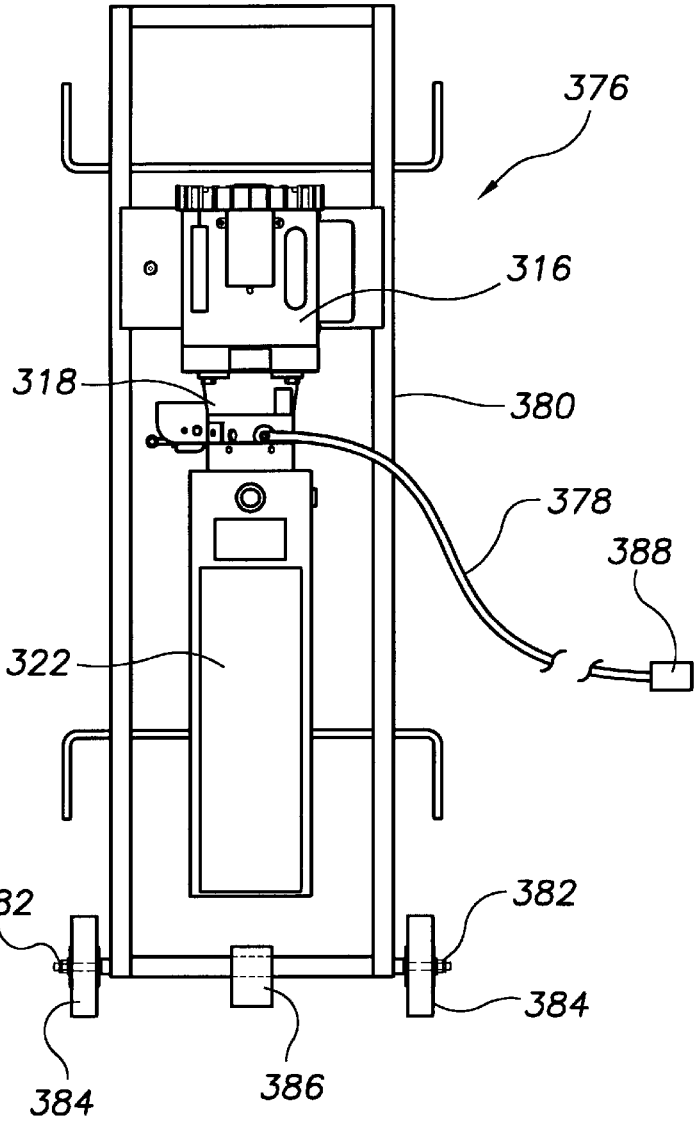
FIG. 20 is a front view of a portable power unit of the lift assembly.

Referring to FIGS. 20 and 21, there is depicted a portable power unit 376 which supplies hydraulic pressurized fluid and is a conduit for providing pneumatic pressurized fluid, through removably connected hydraulic supply line 378 and removably connected pneumatic supply line (not shown) to the respective hydraulic cylinders of lifting mechanisms 58, 258 and air cylinders of safety struts 76, 276 (FIG. 1). Power unit 376 may include motor 316, hydraulic pump 318 and reservoir 322 (see also FIGS. 18–19), all bolted to power unit dolly frame 380. Frame 380 is constructed of welded 1 inch square structural steel tubing. The bottom of the frame has axles 382 and wheels 384 allowing easy portability of the unit, and a bent flat steel bar 386, ensuring tilt prevention for the dolly's stationary upright position. Quick connect/disconnect fittings 388 are provided on all the hydraulic and pneumatic lines 378 coming from the power unit and joined to the respective hydraulic cylinders of lifting mechanisms 58, 258 and air cylinders of safety struts 76, 276. This preferably enables power unit 376 to be quickly and easily disconnected from the lift assembly and relocated to another lifting area. For example, a power unit sold by Monarch Hydraulics, Inc. under model number M-4509-0104 may produce excellent results. The Monarch Hydraulics, Inc. power unit provides only a conduit for providing pneumatic power and any conventional pneumatic supply source or device can be used to supply this utility. Accordingly, the power unit preferably provides the required hydraulic pressure to hydraulic cylinders 305 and pneumatic pressure to air cylinders 76, 276, as required by the invention. Alternatively, these pressure utilities could be provided separately or by an independent source.

Excellent results are contemplated when the lift assembly 200 or lift apparatus 10, 210 are those components, materials and dimensions corresponding to the vehicle lift commercially available and known as model USL-6000 sold by Mohawk Resources, Ltd. of Amsterdam, N.Y., the assignee of this application. In particular, for example, these are the following. Lift assembly 200 may weigh 1700 pounds and have a lift capacity of about 6000 pounds with lift speed of 45 seconds @208/230 VAC or 90 seconds @110 VAC. The motor 316 of power unit 376 may be a 208/230 VAC single phase, 60 Hz (three phase optional) or 110 VAC single phase, 60 Hz. Lift assembly 200 may have: an overall length of 98 and ½ inches; overall width of 45 and ⅜ inches; lift height at top of lifting platform of 5 feet, 11 and ¾ inches; lift height at top of swing arm of six feet and ½ inch; maximum lift height with swing adaptor of six feet, 4 and ½ inches; minimum lowered lifting platform height of 4 and ¾ inches; minimum lowered lifting platform height with swing arm of 5 and ½ inches; maximum swing arm reach (longitudinal) of 70 and ¼ inches; width between lifting platforms of 27 and ⅜ inches; and lifting platform width of 9 inches.

However, as various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

We claim:

1. A lift apparatus for use in lifting a vehicle from a substantially flat surface, comprising:

a pair of levers including a first lever and a second lever pivotally joined together cris-crossing one another and operable in a scissor-like motion between a collapsed position and a lifted position, each lever having an upper portion terminating in a top end and a lower portion terminating in a bottom end so that the top end of each lever lies opposite the bottom end of the other when the levers are in the collapsed position;

a lifting platform operatively coupled to the top ends of the levers for supporting a vehicle thereon;

a lifting mechanism operably coupled to the pair of levers for operating the pair of levers between the collapsed position and the lifted position and thereby raising and lowering the lifting platform; and an extendable safety strut incrementally lockable against motion in one direction and sharing no structure with aid lifting mechanism, said safety strut having two ends, one of which is pivotally connected to the first lever at a point along its upper portion and the other end of which is pivotally connected to the second lever at a point along its lower portion.

2. The lift apparatus of claim 1, wherein the safety strut includes a rack and cam mechanism which automatically incrementally locks the safety mechanism as the pair of levers are moved from the collapsed position to the lifted position and wherein the cam can be selectively disengaged from the rack to permit the pair of levers to be operated from the lifted position to the collapsed position.

3. The lift apparatus of claim 1, further comprising a lift assembly, the lift assembly including-a second pair of levers which include a second lifting platform, a second lifting mechanism and a second safety strut, wherein each pair of levers is sychronistically joined with the other pair of levers in an opposing substantially parallel relationship and wherein the pairs of levers are joined together substantially only proximate the flat surface when each is in a position other than the collapsed position.

4. The lift apparatus of claim 3, further comprising a ground engaging member connected between an adjacent rear bottom portion of each respective pair of levers and wherein the ground engaging member substantially fixes the adjacent rear bottom portions to prevent linear movement thereof relative to the flat surface when the pairs of levers are moved between the collapsed position and the lifted position.

5. The lift apparatus of claim 4, further comprising a synchronization member connected between an adjacent front bottom portion of each respective pair of levers and proximate the flat surface wherein each the adjacent front bottom portions each include a roller which slidingly engages the flat surface when the pairs of levers are moved between the collapsed position and the lifted position.

6. The lift apparatus of claim 4, further comprising a towing member removably attachable with the ground engaging member in between the pairs of levers by a tow support positioned between a pair of ears connected to the ground engaging member.

7. The lift apparatus of claim 3, wherein each lifting mechanism includes a hydraulic cylinder and a hydraulic fluid supply system.

8. The lift apparatus of claim 7, wherein each hydraulic cylinder includes at least one velocity fuse.

9. The lift apparatus of claim 7, wherein the hydraulic fluid supply system includes a pressure compensated flow control valve.

10. The lift apparatus of claim 3, further comprising a pair of longitudinal tracks in which each of the pair of longitudinal tracks is locatable adjacent the lifting platform of each respective pair of levers.

11. The lift apparatus of claim 10, wherein the pair of longitudinal tracks each comprise a lifting track which is removably attached to the lifting platform of each respective pair of levers.

12. The lift apparatus of claim 10, wherein the pair of longitudinal tracks each comprise a stationary track which is positionable along side the lifting platform of each respective pair of levers and is disconnected therefrom.

13. The lift apparatus of claim 3, further comprising at least a pair of lifting accessories from the group consisting of lifting pads, height adapters and rubber blocks wherein each of the pair of lifting accessories is removably joined with the lifting platform of each respective pair of levers.

14. The lift apparatus of claim 13, further comprising at least a pair of swing arms wherein each of the pair of swing arms is removably joined to the lifting platform of each respective pair of levers.

15. The lift apparatus of claim 14, wherein each of the pair of lifting accessories is removably connected to one respective swing arm.

16. The lift apparatus of claim 3, further comprising a portable power unit which supplies hydraulic and pneumatic pressurized fluid through removably connected supply lines to the lifting mechanisms and the safety locks.

17. The lift apparatus of claim 16, wherein the removably connected supply lines include at least one quick disconnect fitting.

* * * * *

UNITED STATES PATENT AND TRADEMARK OFFICE

CERTIFICATE OF CORRECTION

PATENT NO. : 6,182,796 B1
DATED : February 6, 2001
INVENTOR(S) : Perlstein et al.

It is certified that error appears in the above-identified patent and that said Letters Patent is hereby corrected as shown below:

Column 9,
Line 23, delete "aid" and insert -- said --

Column 10,
Line 49, after the word quick, delete the word "disconnect" and insert -- connect/disconnect --

Signed and Sealed this

Ninth Day of October, 2001

*Attest:*

Nicholas P. Godici

*Attesting Officer*

NICHOLAS P. GODICI
*Acting Director of the United States Patent and Trademark Office*